US005719993A

United States Patent [19]

Kleijn

[11] Patent Number: 5,719,993

[45] Date of Patent: Feb. 17, 1998

[54] LONG TERM PREDICTOR

[75] Inventor: Willem Bastiaan Kleijn, Basking Ridge, N.J.

[73] Assignee: Lucent Technologies Inc., Murray Hill, N.J.

[21] Appl. No.: 579,051

[22] Filed: Dec. 21, 1995

Related U.S. Application Data

[63] Continuation of Ser. No. 83,426, Jun. 28, 1993, abandoned.

[51] Int. Cl.[6] ..... G10L 3/02; G10L 9/00; G10L 5/02

[52] U.S. Cl. ..... 395/2.29; 395/2.71; 395/2.28

[58] Field of Search ..... 395/2.29, 2.71, 395/2.28

[56] References Cited

U.S. PATENT DOCUMENTS

| | | | |
|---|---|---|---|
| 4,980,916 | 12/1990 | Zinser | 381/36 |
| 5,093,863 | 3/1992 | Galand et al. | 381/38 |
| 5,195,168 | 3/1993 | Yong | 395/2 |
| 5,267,317 | 11/1993 | Kleijn | 381/38 |
| 5,327,520 | 7/1994 | Chen | 395/2.28 |

OTHER PUBLICATIONS

Kleijn, et al. "Generalized Analysis–By–Synthesis Coding and Its Application to Pitch Prediction", 1992 IEEE, ICASSP, vol. 1 (1992) pp. 337–340.

Marques, et al. "Improved Pitch prediction With Fractional Delays in Celp Coding", 1990 ICASSP, vol. 2 (1990), pp. 665–668.

Tzeng, "Pitch–Tracked Celp Speech Coding With Transparent DTMF Signalling", 3rd IEEE Int'l Symposium on Personal, Indoor & Mobile Radio Commun. Proc., 1992, pp. 670–674.

*Primary Examiner*—Allen R. MacDonald
*Assistant Examiner*—Robert Sax
*Attorney, Agent, or Firm*—Thomas A. Restaino; Kenneth M. Brown

[57] ABSTRACT

An improved long-term predictor (LTP) for use in analysis-by-synthesis coding systems, such as CELP is disclosed. The invention provides control of the periodicity of speech signals generated by the LTP. This control facilitates a reduction in perceptible noise/buzziness in reconstructed speech. An embodiment of the invention includes a conventional LTP in combination with a two-tap finite impulse response filter. The filter augments operation of the LTP by generating precursor signals of LTP output signals. These precursor signals are combined with the LTP output signals to form the output of the improved LTP.

20 Claims, 6 Drawing Sheets

LONG TERM PREDICTOR

This application is a continuation of application Ser. No. 08/083,426, filed on Jun. 28, 1993, now abandoned.

FIELD OF THE INVENTION

The present invention is related generally to speech coding systems and more specifically to speech coding systems with pitch prediction.

BACKGROUND OF THE INVENTION

Speech coding systems function to provide codeword representations of speech signals for communication over a channel or network to one or more system receivers. Each system receiver reconstructs speech signals from received codewords. The amount of codeword information communicated by a system in a given time period defines the system bandwidth and affects the quality of the speech received by system receivers.

The objective for speech coding systems is to provide the best trade-off between speech quality and bandwidth, given conditions such as the input signal quality, channel quality, bandwidth limitations, and cost. To reduce speech coding system bandwidth, redundancy is removed from the speech signal prior to transmission. Among the redundancies that can be exploited is the periodic nature of voiced speech. In many speech coders, this long-term redundancy is removed with a pitch or long-term predictor. At the system receiver a second long-term predictor is used to regenerate the periodicity in the reconstructed speech signal. Note that the term long-term predictor often refers to related but different structures in the system receiver and the system transmitter.

Long-term predictors are commonly applied to a class of coders called analysis-by-synthesis coders. A well-known representative of this class is code-excited linear prediction (CELP). In analysis-by-synthesis coders, speech signals are coded using a waveform-matching procedure. The speech is divided into segments which are called subframes. For each subframe, a candidate reconstructed speech signal is constructed for each of a large set of parameter configurations. Each of the parameter configurations is fully defined by a number of indices. Each candidate is compared to the original speech signal to determine which candidate most closely matches the original speech. The matching procedure is tailored to the properties of the human auditory system through the use of perceptual weighting. The indices corresponding to the best matching candidate reconstructed speech signal are transmitted over the channel. From the indices, the system receiver determines the correct parameter configuration and creates the reconstructed speech signal.

In analysis-by-synthesis coders, the long-term predictor generally is an integral part of the waveform matching process. In a common configuration, the long-term predictor uses a segment of the past reconstructed signal to match an original signal in the present subframe. Past reconstructed speech is related in time to original (present) speech by an interval known as delay. Such reconstructed speech may be scaled by a gain. Both the gain and the delay of the past segment are adjusted to provide the best match to the original speech signal.

The long-term predictor greatly enhances the coding efficiency of analysis-by-synthesis coders. This is confirmed by objective measurements, which show significant improvements in the signal-to-noise ratio of the reconstructed speech signal. However, the human auditory system is very sensitive to distortions in the speech signal which are related to the periodicity. For example, speech coders are often perceived to be noisy or buzzy—both distortions which are related to the level of periodicity of the reconstructed speech. These distortions generally become stronger when coding bit rate is decreased.

The degree of periodicity in a natural speech signal generally decreases with increasing frequency. In a conventional long-term predictor, periodicity is controlled by only one parameter, the long-term predictor gain. Despite the fact that this parameter does not vary with frequency, the periodicity of the reconstructed signal is not constant as a function of frequency. This is because the periodicity is dependent upon nonstationarity of the long-term predictor, as well as other factors. However, this frequency dependence cannot be adjusted separately for different frequencies. This shortcoming may lead to perceptible noise and/or buzziness in the reconstructed speech, especially at low bit rates and in the lower frequency regions, where the human auditory system has a high frequency resolution capability.

SUMMARY OF THE INVENTION

The present invention provides an improved long term predictor for use in analysis-by-synthesis coding systems, such as CELP. The invention provides control of the periodicity of speech signals generated by the LTP to reduce perceptible noise or buzziness in reconstructed speech.

An illustrative embodiment of the present invention comprises a conventional LTP in combination with a two-tap finite impulse response (FIR) falter. The falter functions to augment the operation of the conventional LTP by generating one or more precursor signals of the conventional LTP output signals. Once generated, the precursor signals are combined with the output signal of the conventional LTP to form the output of the improved LTP.

In accordance with this embodiment, input speech signal samples are provided to a delay unit and subsequently provided to a conventional LTP for processing. The delay provided by the delay unit enables the generation of signals which "precede" (or are precursors to) the output of the conventional LTP. Contemporaneously, the input speech signal samples are provided to the FIR filter which generates signals which are one and two pitch-periods in advance of a delayed output of the conventional LTP. Each such signal is attenuated by a filter tap gain such that the envelope formed by these signals is a ramp which increases with time. These attenuated signals are precursors of a sample of the delayed conventional LTP output signal. Each of the two signals is then filtered by a low-pass filter prior to being combined with the output of the conventional LTP. This combined LTP output signal—the output signal of the improved LTP—exhibits greater periodicity at lower frequencies than does the output of the conventional LTP.

DETAILED DESCRIPTION

Illustrative Embodiment Hardware

For clarity of explanation, the illustrative embodiment of the present invention is presented as comprising individual functional blocks (including functional blocks labeled as "processors"). The functions these blocks represent may be provided through the use of either shared or dedicated hardware, including, but not limited to, hardware capable of executing software. For example, the functions of the blocks presented in FIGS. 2, 3, 6, and 11 may be provided by a single shared processor. (Use of the term "processor" should not be construed to refer exclusively to hardware capable of executing software.)

Illustrative embodiments may comprise digital signal processor (DSP) hardware, such as the AT&T DSP16 or DSP32C, read-only memory (ROM) for storing software performing the operations discussed below, and random access memory (RAM) for storing DSP results. Very large scale integration (VLSI) hardware embodiments, as well as custom VLSI circuitry in combination with a general purpose DSP circuit, may also be provided.

Introduction to the Illustrative Embodiment

Figure 1:
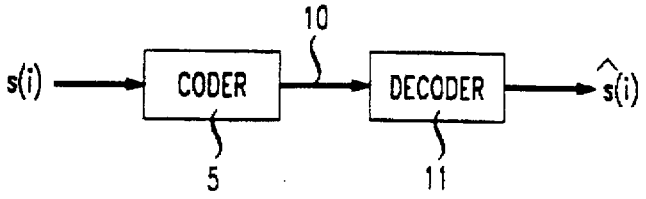
FIG. 1 (PRIOR ART)
FIG. 1 shows a block diagram of a basic coder-decoder system.

The basic outline of an illustrative digital speech-coding system is shown in FIG. 1. A discrete speech signal s(i) is received by a coder 5. The discrete speech signal is typically received from a analog-to-digital converter (D/A) or from a digital network (not shown). The coder 5 encodes the signal into a stream of codeword information signals which is transmitted over a channel 10 to a decoder 11.

Channel 10 may be, e.g., a digital network and a digital radio link. Channel 10 may also include or consist of a signal storage medium. Generally, the bit rate of the stream of codeword information signals is less than that required for the discrete speech signal, s(i), or represents the speech signal in a way such that it is less sensitive to channel errors, or both. The decoder 11 creates a reconstructed speech signal, $\hat{s}(i)$, using the stream of codeword information signals. Usually, it is desirable to make the reconstructed speech signal perceptually similar to the original speech signal. Note that a perceptually similar signal is not necessarily similar under objective measures such as signal-to-noise ratio.

Figure 2:
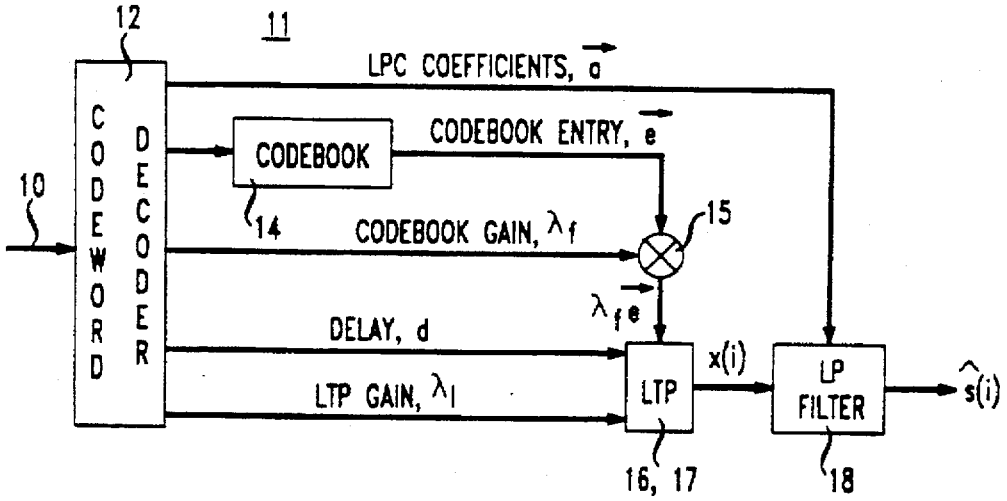
FIG. 2 shows a block diagram of a general system receiver.

FIG. 2 presents decoder 11 for an illustrative CELP speech-coding system. The stream of codeword information signals which arrives over the channel 10 is provided codeword decoder 12. As is conventional in CELP decoders, decoder 12 separates the received stream of codeword information signals into segments with a fixed number of bits, each containing a description of one frame of speech. In CELP, a frame is typically about 20 ms in length. Generally, each frame consists of an integer number of subframes. In CELP, these subframes are typically on the order of 2.5 to 7.5 ms in length.

For each frame, one set of indices describing quantized linear-prediction (LPC) coefficients, $\vec{a}$, is transmitted from coder 5. These coefficients are used in a conventional linear-prediction synthesis filter 18, which controls the envelope of the power spectrum of the output signal, $\hat{s}(i)$. Often, the transmitted linear-prediction coefficients represent (or are valid at) the future-side frame boundaries. Linear prediction coefficients for each subframe are computed by decoder 12 by interpolation of the transmitted coefficients, as is conventional. This interpolation prevents large discontinuities in the filter impulse response, and has been found to provide a more accurate representation of the local envelope of the power spectrum.

Except for the linear prediction coefficients, $\vec{a}$, all CELP parameters are transmitted separately for each subframe. A codebook index k is used to select a vector from a codebook of excitation vectors 14. Because this codebook 14 does not change over time, it is commonly referred to as a fixed codebook. The dimension of an excitation vector from codebook 14 (e.g., 40 samples) multiplied by the sampling period (e.g., 0.125 ms) matches the length of a subframe (e.g., 5 ms given these numbers). The codebook excitation vector $\vec{e}$ is multiplied by the codebook gain $\lambda_f$, by multiplier 15. The resulting vector $\lambda_f\vec{e}$ used as input to the long-term predictor 16. For each subframe, a long-term predictor 16, 17 also receives a delay value d and a gain $\lambda_l$. The delay value d may be noninteger. In some embodiments this delay and/or gain may be transmitted less often than once for each subframe. These parameters may be interpolated as is conventional on either a subframe-by-subframe or a sample-by-sample basis as needed. As discussed above with reference to the LPC coefficients, such interpolation operations are illustratively performed by codeword decoder 12, with the results provided to the long-term predictor 16 for each sample.

The output, x(i), of the long-term predictor 16, 17 is an excitation (input) signal for the conventional linear-prediction synthesis filter 18. The excitation signal, x(i) has an essentially flat envelope for the power spectrum, although it does contain small fluctuations. The filter 18 adds the appropriate spectral power envelope to the signal. The resulting output signal is the reconstructed speech signal $\hat{s}(i)$.

Figure 3:
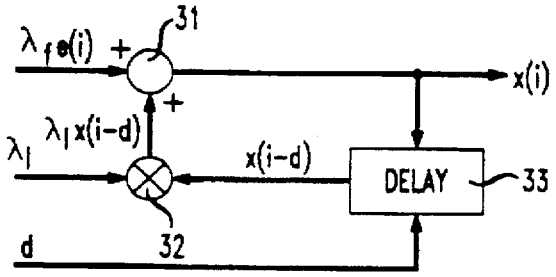
FIG. 3 (PRIOR ART)
FIG. 3 shows a block diagram a conventional long-term predictor.

FIG. 3 shows a conventional long-term predictor 16 in more detail. It operates on a sample by sample basis. The delay unit 33 comprises a delay line and processor. The delay line holds the signal values x(i), x(i–1), x(i–2), . . . , x(i–D). D is chosen to be sufficiently large such that for most speech signals an entire pitch cycle can be stored in the delay line and noninteger speech signal samples can be calculated by conventional band-limited interpolation. A typical value ford is 160, for sampling period of 0.125 ms. The delay value d coming from the codeword decoder 12 is used to select the value x(i–d) from the delay line. If the value of d is noninteger the value x(i–d) is computed in conventional fashion by the processor of unit 33 with bandlimited interpolation of samples of x. The system coder 5 is set up such that d is never larger than D (taking into account the interpolation filter length). The delayed signal x(i–d) is multiplied by the long-term predictor 16 gain $\lambda_l$ by multiplier 32. The resulting signal $\lambda_l x(i-d)$ forms the long-term predictor contribution to the excitation signal x(i).

The scaled vectors, $\lambda_f \vec{e}$, from the fixed codebook 14 are used by the long-term predictor 16 on a sample-by-sample basis. A signal $\lambda_f e(i)$ is obtained by simply concatenating the vectors $\lambda_f \vec{e}$, each vector, $\lambda_f \vec{e}$ comprising scalar samples. The signal $\lambda_f e(i)$ forms the fixed-codebook contribution to the excitation signal, x(i). The fixed-codebook contribution and the long-term predictor contribution are added with adder 31, the result being the excitation signal x(i).

Figure 4A:
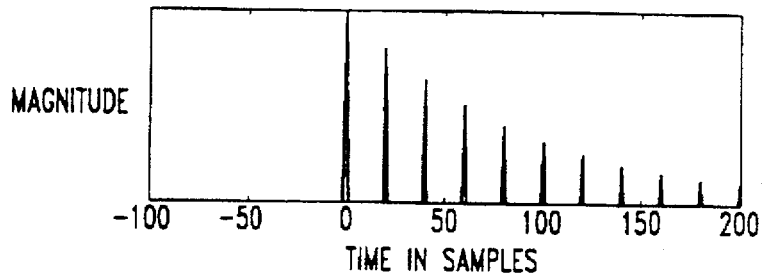
FIGS. 4*a* and *b* show a steady-state impulse response and the associated power spectrum for a conventional long-term predictor.
Figure 4B:
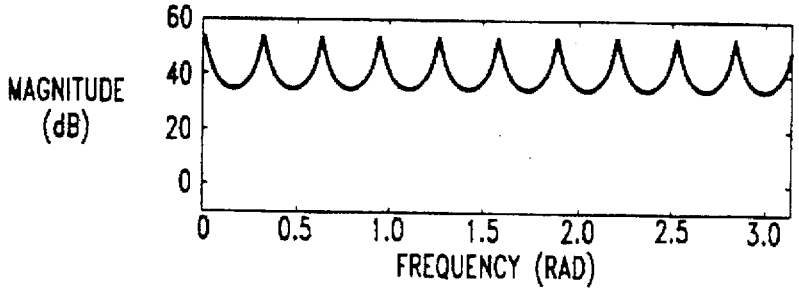
FIG. 4B (PRIOR ART)

FIG. 4*a* shows part of the impulse response of the conventional pitch predictor of FIG. 3, for the case where long-term predictor gain $\lambda_l$=0.8 and d=20. Thus, this is the output x(i) of the long-term predictor if the fixed-codebook contribution is replaced with a signal g(i) which is zero everywhere, except at i=0, where this signal is unity, g(0)=1, g(i)=0,i≠0. As shown in FIG. 4*a*, the pulses of the output signal x(i) have an abrupt start at i=0 and then decay exponentially over time. FIG. 4*b* shows the logarithmic power spectrum associated with the complete impulse response. To make the signal more periodic, or, equivalently, to make the harmonic structure of the power spectrum more pronounced, the long-term predictor gain $\lambda_l$ can be increased. However, increasing the gain will slow the response time of the long-term predictor. Note that increasing the gain of the long-term predictor does not eliminate the abrupt rise of the impulse response at i=0.

A First Illustrative Embodiment

Figure 5A:
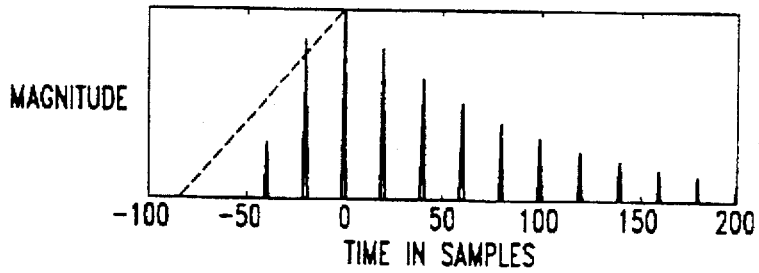
FIGS. 5*a* and *b* show a steady-stage impulse response and the associated power spectrum for a modified long-term predictor.
Figure 5B:
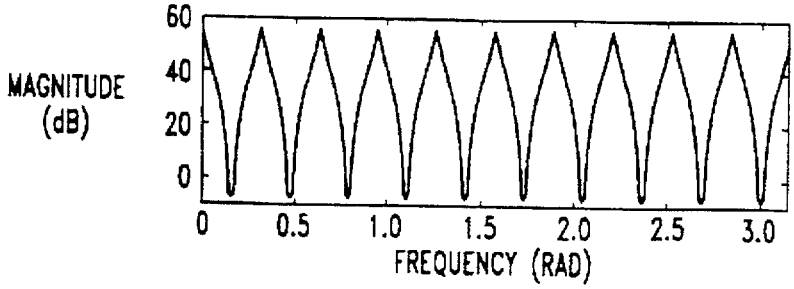

In accordance with the present invention, enhanced periodicity is obtained by eliminating the abrupt start of the pulses. FIG. 5*a* shows an impulse response in accordance with the present invention, where the pulses increase slowly in amplitude before i=0, but where the impulse response is unchanged from that of FIG. 4*a* after i=0. The part of the impulse response appearing before i=0 will be referred to as a ramp segment of the impulse response. It is seen in FIG. 5*b* that this ramp segment results in significantly increased periodicity. In accordance with an illustrative embodiment of the invention, the signal $\lambda_f e(i)$ is delayed within the LTP by L samples, L being a fixed number typically corresponding to about 10 to 20 ms.

Figure 6:
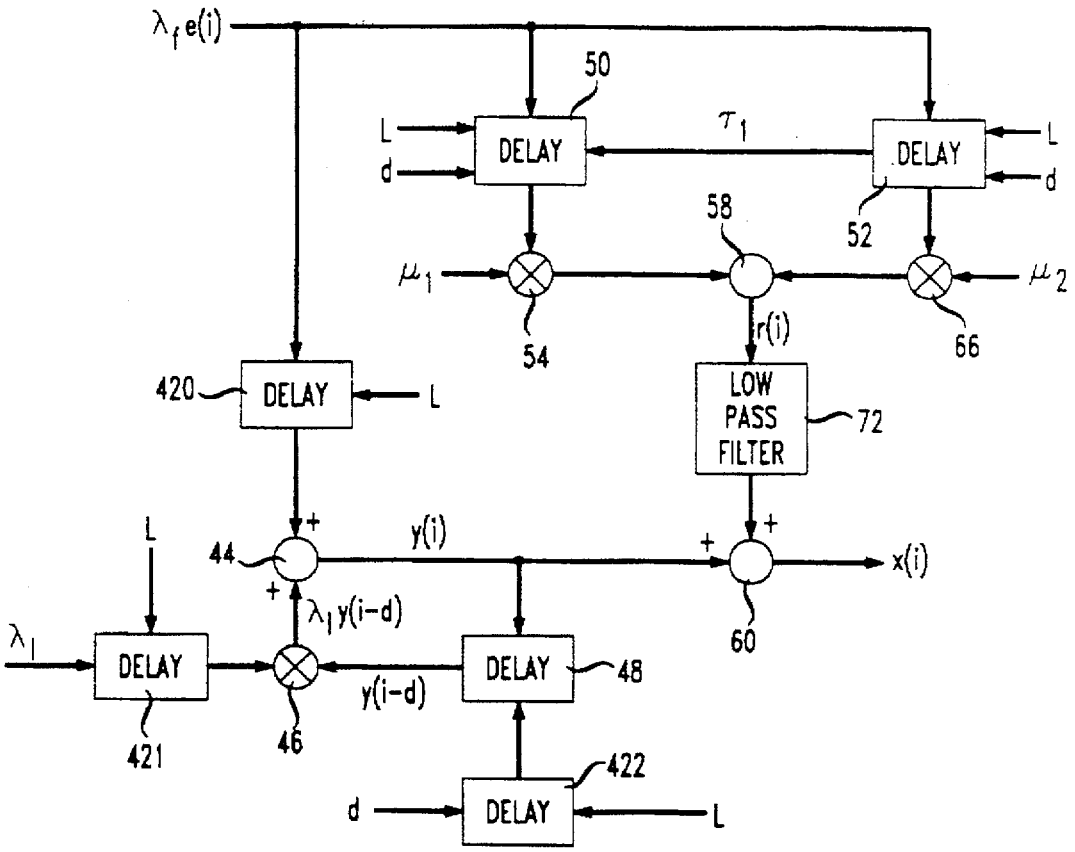
FIG. 6 shows a block diagram of a first embodiment of a modified long-term predictor in accordance with the present invention for use in the system receiver of FIG. 2.

FIG. 6 presents an illustrative LTP 17 in accordance with the invention. In this case, the ramp segment is of length up to two pitch cycles, corresponding to the two nonzero points before i=0 in FIG. 5*a*. Exactly the same principles can be used for a ramp length of more than 2 pitch cycles. The LTP 17 of FIG. 6 is advantageously used to replace the conventional LTP 16 shown in FIG. 3. The signal y(i) is identical to the excitation signal x(i) in FIG. 3, except that it is delayed by L samples. However, an additional contribution is added to this signal in adder 60, and the resulting signal is a new excitation signal x(i). Note that the signal x(i) is delayed L samples as compared to the excitation signal in FIG. 3, and that the other parameters used in the synthesis structure of FIG. 2 must be delayed appropriately. Thus, the linear-prediction filter coefficients used in the linear-prediction synthesis filter must also be delayed by L samples. The delay of the remaining parameters will be described the detailed description of FIG. 6, which follows next.

The intermediate signal y(i) is delayed by d samples in the delay unit 48, which is identical in function to delay unit 33. The signal y(i–d) is multiplied by the long-term predictor gain $\lambda_l$ to give the long-term predictor contribution, $\lambda_l y(i-d)$, to the excitation signal x(i). The values of both the delay d and the gain $\lambda_l$ are delayed by L samples, by delay units 422 and 421, to account for the delay of L samples in the excitation signal x(i).

The fixed-codebook contribution is delayed by L samples in delay unit 420 and added to the long-term predictor contribution, $\lambda_l y(i-d)$, in adder 44, resulting in the intermediate signal y(i). If the system transmitter is the same as before, then y(i) is the same signal as x(i) in FIG. 3, but delayed by L samples.

In the first illustrative embodiment, the ramp segment of the impulse response is created by a filter with two taps separated by delay d. In accordance with the embodiment, d may be constant or time varying. The operation of the first embodiment given a fixed delay, d, will be discussed first. This discussion is followed by one addressing the more general case where d is time varying.

For a case where d is a constant integer in sample time, the fixed-codebook contribution is delayed by L–2d samples by delay unit 50 to create the first nonzero sample of the impulse response. The resulting signal $\lambda_f e(i-L+2d)$ is multiplied by a gain $\mu_1$ (which has a value of 0.3 in the example of FIG. 5) in multiplier 54. The signal $\lambda_f e(i)$ is delayed by L–d samples by delay unit 52, resulting in a signal $\lambda_f e(i-L+d)$, which is multiplied by a gain $\mu_2$ (which has a value of 0.85 in the example of FIG. 5) in multiplier 66. The resulting two signals are added by adder 58 to provide a ramp segment contribution, $r(i)=\mu_2\lambda_f e(i-L+2d)+\mu_1\lambda_f e(i-L+d)$. The summation of this signal, r(i), and the intermediate signal y(i) results in the excitation signal x(i) which is used as input for the linear-prediction synthesis filter (which employs the delayed linear-prediction filter coefficients). (For present purposes, the effect of a low pass filter 72 shown in FIG. 6 need not be considered—it may be viewed simply as a wire; however, the use and effects of this filter 72 will be discussed below in connection with FIGS. 7*a* and 7*b*).

The numerical value of $\mu_1$ is advantageously a function of the delay time d, and the value of $\mu_2$ a function of the delay time 2d (when the delay is not constant these two delays are not related by a simple multiplicative factor). In general, it is desirable to decrease the gains with increasing value of d and 2d. Such a decrease in gain values is illustratively provided by a simple ramp function such as that shown by the broken line in FIG. 5*a*. Whenever 2d exceeds L, the delay unit 52 sets its output equal to zero for reasons of causality. It is also desirable to smoothly decrease $\mu_2$ with increasing d and make $\mu_2$ equal to zero at 2d=L. Similarly, when d exceeds L the delay unit 50 sets its output equal to zero. Again, it is desirable to smoothly decrease $\mu_1$ with increasing d and make $\mu_1$ equal to zero at d=L.

The above description of the ramp segment contribution, r(i), to the excitation signal concerned the case of integer constant d. In some CELP systems, however, d is a non-integer which changes either from subframe to subframe or from sample to sample. The delay at sample k may therefore be denoted as d(k). The signal which enters multiplier 66 from delay unit 52 must be exactly one pitch cycle ahead of the signal y(i), which itself is delayed by L samples. The LTP delay d(i) only provides the length of the pitch cycle when looking backward in time. However, d(i) can be used to determined the length of the pitch cycle looking forward in time (i.e., into the future) as required. For notation purposes, the length of a pitch cycle looking forward in time will be written as q(i). If the time instant one pitch cycle ahead of sample i–L is denoted by $\tau_1$, and the sample time i–L is one pitch period behind $\tau_1$, a relationship between the LTP delay, d, at time $\tau_1$ in the future and the time interval between the present time, i–L, and the future $\tau_1$ can be written as:

$$d(\tau_1)=\tau_1-(i-L)=q(i-L). \quad (1)$$

From this relationship, a value for $d(\tau_1)$ may be determined and a fixed codebook contribution at $\tau_1$ may also be determined for use as a delay unit output.

Figure 10:
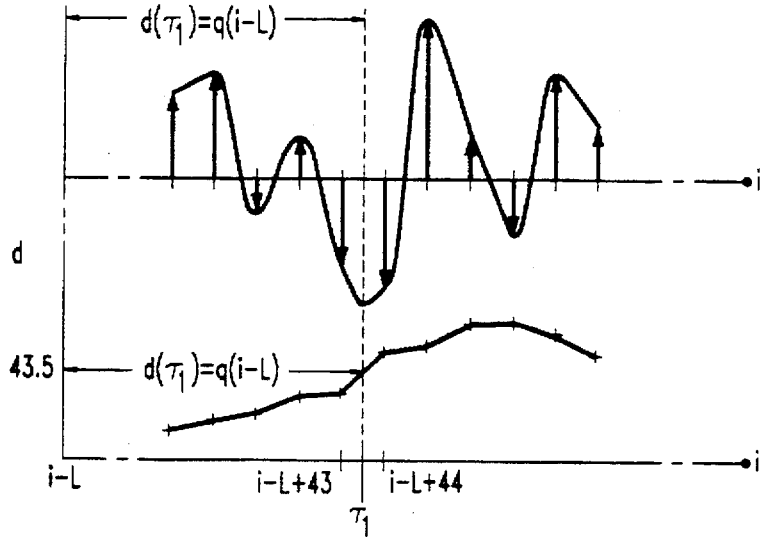
FIG. 10 presents the contents of the delay unit.

FIG. 10 illustrates graphically a solution to equation (1). The Figure presents the contents of the buffer of delay unit 52 from i–L to i. The waveform reflects a portion of a sequence of samples $\lambda_y e(k)$, $i-L \leqq k \leqq i$. The waveform is delayed by L samples. Thus, the buffer output at time i corresponds to the buffer index i–L. Through a solution to equation (1), the buffer unit 52 creates a precursor to $\lambda_y e(i-L)$. Below the waveform is a graph of LTP delay values on a sample basis, k. This graph is an example of an LTP delay contour. The goal of solving equation (1) is to find the sample (waveform feature) in the buffer which is the pitch cycle ahead of buffer index i–L. The location of this sample in time is identified as $\tau_1$. In general, $\tau_1$ does not have to be at an integer sample time. Illustrated in the Figure is a $\tau_1$ which is 43.50 samples ahead of index i–L. The waveform value at time $i-L+d(\tau_1)$ (=i–L+43.5) corresponds to the output of the delay unit.

Sample values output from the delay unit 52 are generated as follows. Delay unit 52 comprises a memory and a processor. The memory of unit 52 stores discrete LTP delay values, d(k), for all values of k between i–L and i, and fixed codebook vector contributions, $\lambda_k e(i)$, valid at such values of k. The values of d(k) are provided by decoder 12. A solution to equation (1) may be estimated by the processor of delay unit 52 by determining which noninteger time in the future has a corresponding LTP delay which most closely maps back to sample time i–L (such a non-integer sample time is termed $\tau_1$), and thereafter determining the value of a fixed codebook contribution at that noninteger time, $\tau_1$, based on actual fixed codebook sample at sample times surrounding $\tau_1$.

Figure 8:
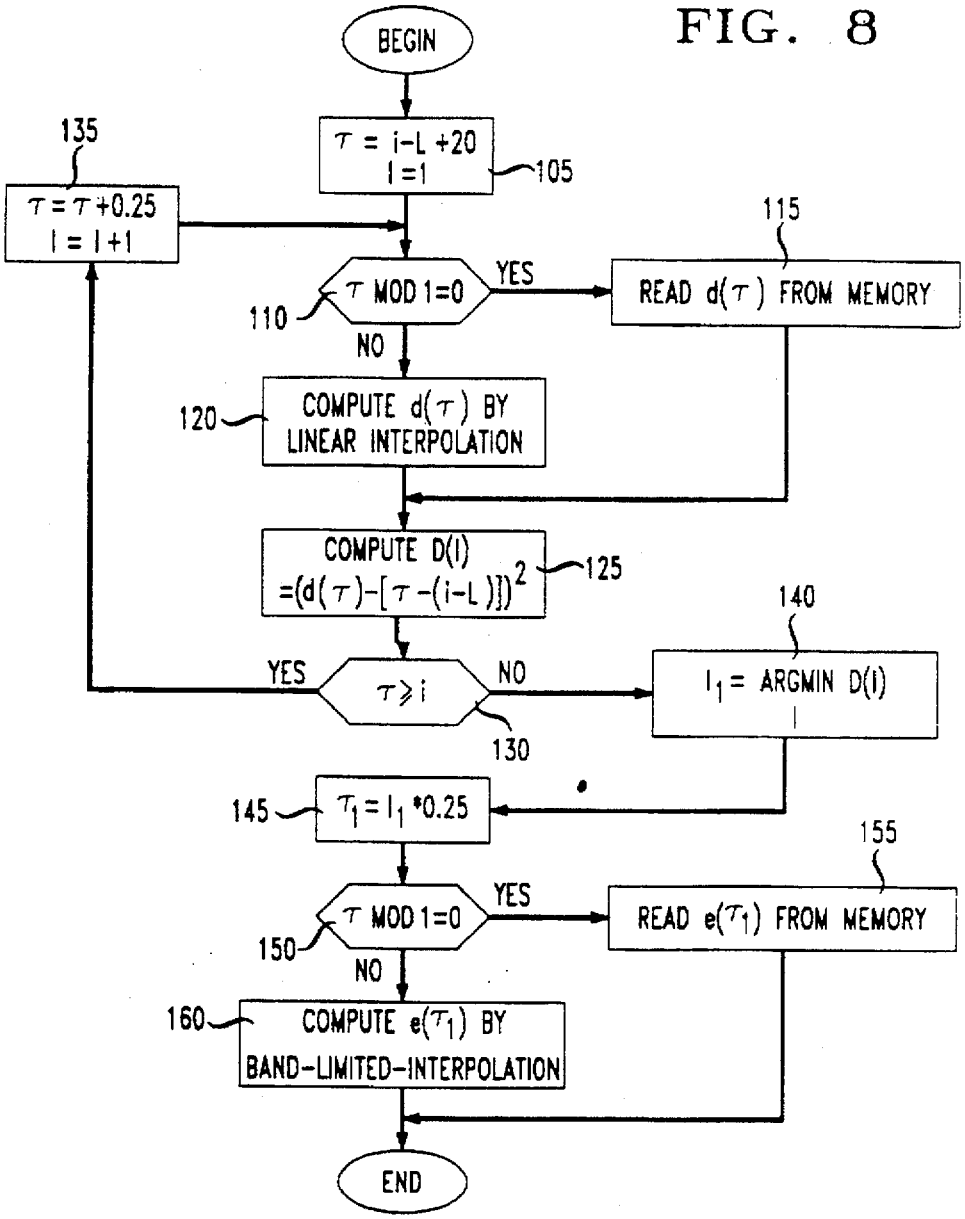
FIG. 8 presents a flowchart of the operation of a delay unit of FIG. 6.
Figure 9:
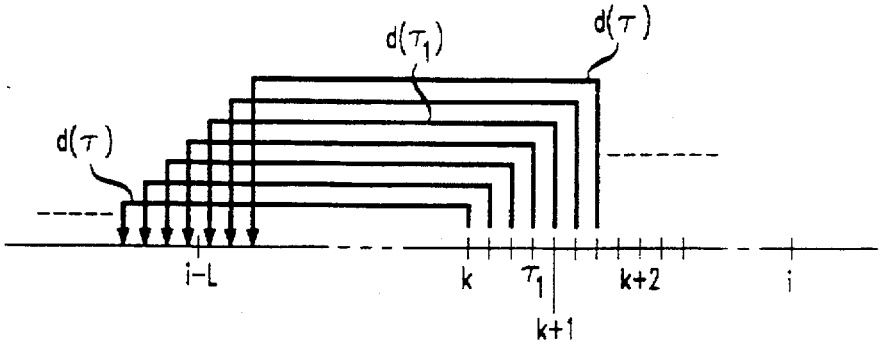
FIG. 9 presents a time diagram associated with the operation of the delay unit of FIG. 6.

To determine $\tau_1$, the processor operates in accordance with software reflected in the flowchart of FIG. 8. The processor uses data stored in memory over the range of sample times $i-L \leqq \tau \leqq i$ (steps 105 and 130). Assuming a conventional sampling rate of 0.125 ms (8,000 Hz), the processor determines values of LTP delay, d, for each 0.25 sample point in the interval by linear interpolation of stored delay values (steps 110, 115, 120). FIG. 9 illustrates the timing associated with the determination of LTP delay values. As shown in the Figure, various values of $d(\tau)$ are computed, the values valid at $\tau$ equal to 0.25 sample increments within the specified range. Each value of $d(\tau)$ points backward in time from the future. For each delay, $d(\tau)$, a difference between the lefthand side and the middle expression of equation (1) is determined (step 125). This difference signifies how closely a given LTP delay, $d(\tau)$, corresponding to a future noninteger sample value compares to the actual time interval between the noninteger future sample value and the present time. The time corresponding to the closest matching LTP delay, $\tau_1$, is determined based on all such delays (steps 140 and 145). Finally, the value of the sample output from the delay unit 50 is determined by a bandlimited interpolation of stored fixed codebook contributions surrounding $\tau_1$ (steps 150, 155, and 160). At time i, the output of the delay unit 52 is $\lambda_y e(i-L+d(\tau_1))$, where $\tau_1$ was determined from the solution of equation (1). If the best solution is $\tau_1 \approx i$, then the output of the delay unit 52 is set to zero.

The value of the delay used by the delay unit 50 is computed in the same fashion as that of delay unit 52. Let the time instant one pitch cycle ahead of sample $\tau_1$ be denoted by $\tau_2$. Thus, $\tau_1$ is one pitch cycle behind $\tau_2$:

$$d(\tau_2)=\tau_2-\tau_1=q(\tau_1). \quad (2)$$

From equation (2) $\tau_2$ can be obtained in a similar fashion as $\tau_1$ was obtained from equation (1). If the best solution is $\tau_2 \approx i$, then the output of the delay unit 50 is set to zero. The delay $d(\tau_2)$ is used to compute the signal $\lambda_y e(i-L+d(\tau_1)+d(\tau_2))$, which is the output of delay unit 50. Then, the adder 58 adds the $\mu_2\lambda_y e(i-L+d(\tau_1)+d(\tau_2)$ and $\mu_1\lambda_y e(i-L+d(\rho_1))$, resulting in the ramp contribution, r(i), to the excitation signal. (As discussed above, for purposes of this discussion filter 72 is assumed to have no effect on the output of adder 58; but see below).

Figure 7A:
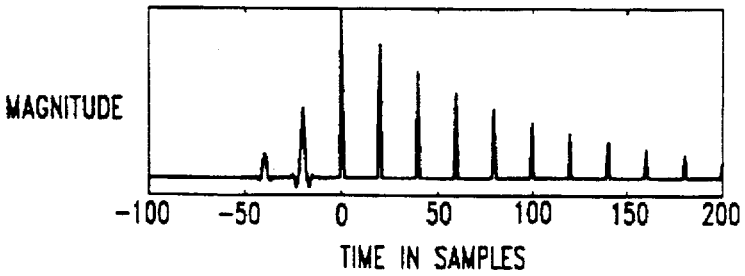
FIGS. 7*a* and *b* show a steady-stage impulse response and the associated power spectrum for a modified long-term predictor.
Figure 7B:
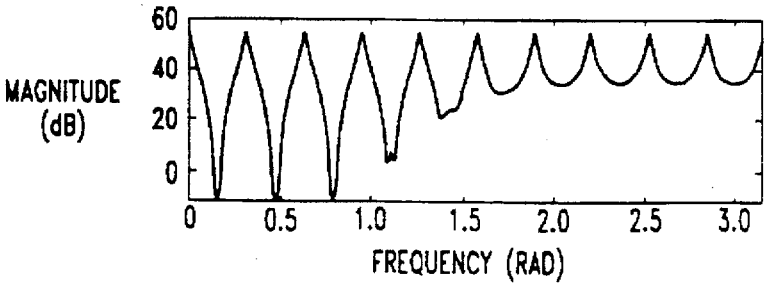

As discussed above, natural voiced speech generally has more periodicity at low frequencies than at higher frequencies. Thus, it is beneficial to enhance periodicity only for the lower frequencies. This is easily accomplished by low-pass filtering the ramp contribution with a linear-phase low-pass filter in unit 72, while correcting for the filter delay. FIG. 7*a* shows the impulse response of the new pitch predictor structure, when a 17 tap linear-phase low-pass filter with a cut-off frequency of about 1.5 rad is applied to the signal r(i) as it was employed in FIG. 5. FIG. 7*b* shows the associated frequency response. It shows that the periodicity of the lower frequencies can be enhanced significantly without affecting the periodicity of the higher frequencies. The use of a low-pass filter with a constant cut-off frequency (of about 1000 Hz) provides a significant perceptual improvement on the ramped pitch predictor without the low-pass filter. Advantageously, the cut-off frequency of the low-pass filter 72 adapts to the properties of the original signal. For example, the periodicity could be estimated for each of a complete set of frequency bands and the cutoff could be determined based on the periodicity of the bands.

A Second Illustrative Embodiment

Figure 12:
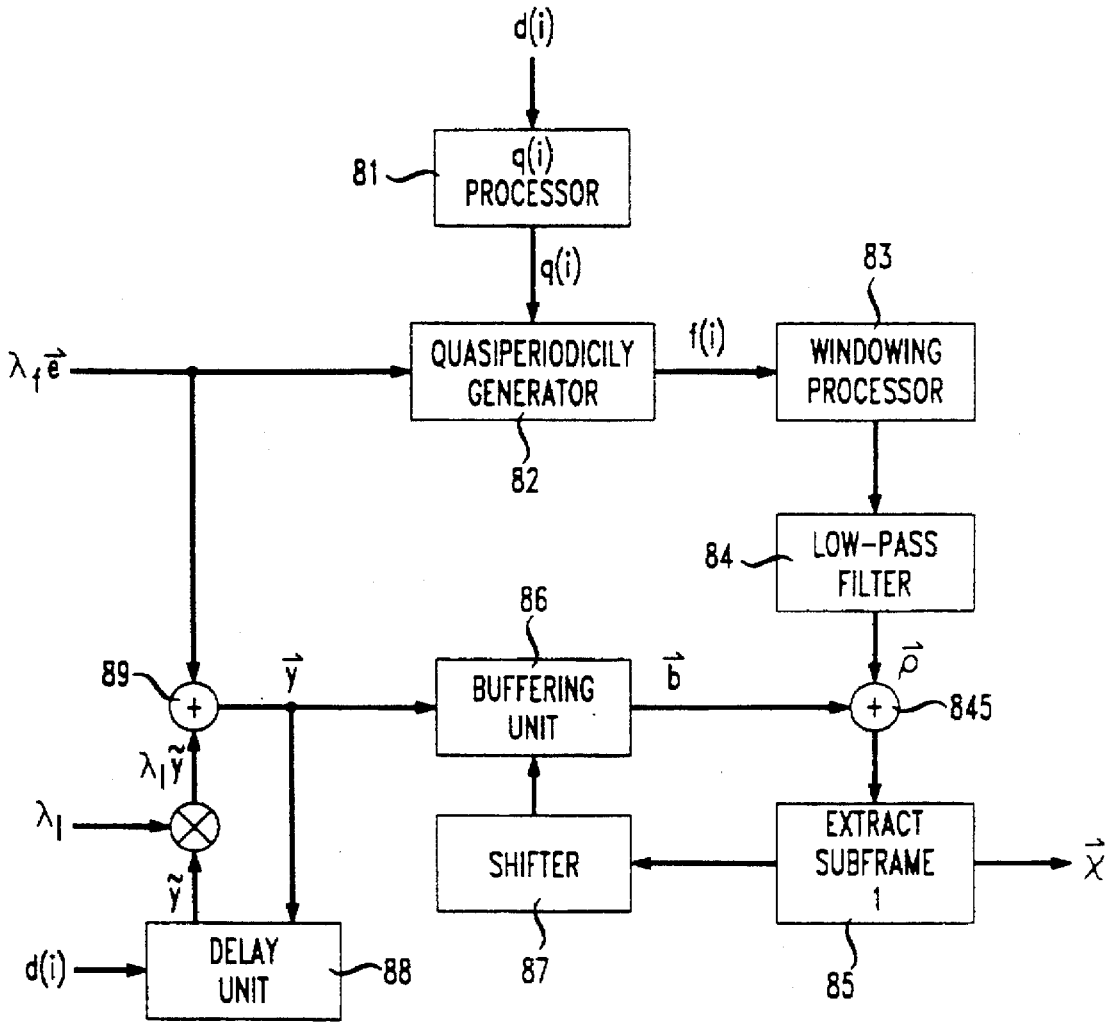
FIG. 12 shows a block diagram of a second embodiment of a modified long-term predictor in accordance with the present invention for use in the system receiver of FIG. 2.

A second illustrative embodiment of the present invention is presented in FIG. 12. This embodiment operates on a subframe by subframe basis. This means that the signals of the embodiment may be thought of as concatenations of vectors, each vector with the dimension of one subframe.

Figure 11A:
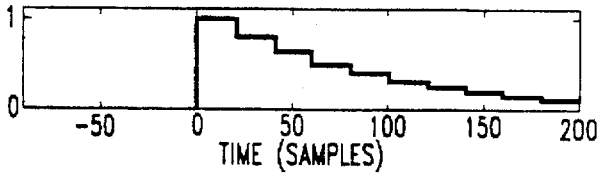
FIG. 11*a* presents a fixed code book response window function of a conventional long term predictor.

The second embodiment is rooted in a different interpretation of the signal processing performed by the LTP. To see this different interpretation, assume the fixed-codebook gains are equal to zero in all but one subframe. The one subframe will be called subframe j. The resulting excitation signal will be referred to as the fixed-codebook response of subframe j, or FCR(j). Note that because of linearity of the pitch predictor, the actual excitation signal consists of a summation of FCR(j) over all j (i.e., over all subframes). In a conventional pitch predictor, FCR(j) will be zero before subframe j, have abrupt onset in subframe j, and then decay with a rate dependent on the long-term predictor gain $\lambda_l$. (In this description, short segments of zero amplitude are ignored.) The FCR(j) can be described as a quasiperiodic (if the pitch period is constant it is exactly periodic) repetition of the fixed-codebook contribution in subframe j multiplied by a window function termed the FCR window. For purposes of this description, the quasiperiodic repetition of the fixed-codebook contribution has constant magnitude, and the FCR window contributes all magnitude variations. In conventional LTPs, the FCR window is zero prior to subframe j, has a sudden rise at the start of subframe j, and then decays over time in a stepwise fashion, with the rate of the decay governed by the long-term predictor gain and the pitch period. FIG. 11*a* presents an FCR window function of a conventional long term predictor. It is the abruptness of the rise of the FCR window which is of major importance to the periodicity of the excitation signal.

Figure 11B:
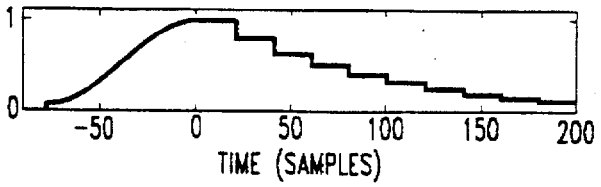
FIG. 11*b* presents a fixed code book response window function employed by the second illustrative embodiment, which window function eliminates the abrupt onset of the window function presented in FIG. 11*a*.

In accordance with the second embodiment of the present invention, the FCR window function is changed so as to eliminate the abrupt rise. Before the beginning of subframe j a ramp is added to the FCR window which smooths the abrupt rise. FIG. 11*b* presents a window function for use with the second embodiment, which employs half a Hamming window to eliminate the abrupt rise depicted in FIG. 11*a*. The best smoothing is obtained when the Hamming part of the window attaches in a continuous function to the existing part of the FCR window. The level of smoothing can be constant, but adaptive changing may result in better performance. A simple example of adaptation of the smoothing is to use a fixed, smoothed FCR window when the long-term predictor gain is equal or larger than 0.6, and to use an unsmoothed FCR window when this gain is less than 0.6.

Figure 11C:
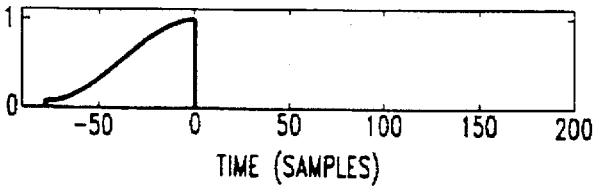
FIG. 11*c* presents half a Hamming window used in forming the window depicted in FIG. 11*b*.

As mentioned above, the excitation signal is an addition of FCR(j) functions for all j. For embodiment implementation purposes it is useful to split each smoothed FCR(j) into two parts, the ramp part (the part before subframe j) and the conventional part (from subframe j onward). The excitation signal contributed by the conventional part of the FCR(j) can be computed in a conventional manner. However, in the second embodiment, the ramp part of each FCR(j) is computed separately, and then added to the conventional excitation signal. (Note that in the first embodiment, the sum of the ramp parts of all of the FCR(j) was computed on a sample-by-sample basis.) The ramp part of the FRC(j) window (i.e., the ramp window) is shown in FIG. 11*c*. The FCR(j) ramp window is fixed in length. An example of an FCR(j) ramp window is one half of a Hamming window as shown in FIG. 11*c*.

FIG. 12 presents the second illustrative embodiment. In q(i)-processor 81, the length of one pitch cycle when looking forward in time, q(i), is computed from the length of each pitch cycle when looking backward in time, d(i) for each sample i by solving:

$$d(\tau)=\tau-i=q(i). \tag{3}$$

The solution of this equation provided by processor 81 is identical to the solution of equation (1) discussed above.

Assuming that the current subframe starts at sample k+1, that the ramp length is M subframes, and that each subframe has sfl samples, q(i) is computed for all samples from i=k−M*sfl+1 through i=k in q(i)-processor 81. For example, for subframes of length 20 samples and a ramp length of 80 samples, M would be 4. Quasiperiodicity generator 82 comprises a buffer memory f which ranges from f(k−M*sfl+1) to f(k+sfl). This buffer is set to zero for each ramp. The fixed-codebook contribution $\lambda_f\vec{e}$, which corresponds to the subframe starting at sample k+1, is then copied by generator 82 into the buffer locations starting at sample k+1 and ending at sample k+sfl. Using the function q(i), generator 82 repeats this signal segment over M subframes prior to k, starting from i=k and working backwards in time to i=k−M*sfl+1 according to the following expressions:

$$f(i)=0,\ i+q(i)>k+sfl,\ k\geqq i>k-M*sfl \tag{4}$$

$$f(i)=f(i+q(i)),\ i+q(i)\leqq k+sfl,\ k\geqq i>k-M*sfl$$

If the values of q(i) are noninteger, bandlimited interpolation is used by generator 82 to compute subframe samples for buffer f(f(i) is then assumed to be zero for i>k+sfl). The final result of the operation of generator 82 described by equation (4) will be a buffer f comprising a quasiperiodic signal segment M subframes in length. If q(i) is constant the signal will be exactly periodic.

The first M*sfl samples of the quasi-periodic signal segment starting at f(k−M*sfl+1), i.e. the samples f(k−M*sfl+1) through f(k), form the output of quasiperiodicity generator 82 and the input of the windowing processor 83. The windowing processor 83 contains the FCR(j) ramp window, an example of which was given in FIG. 11*c*. Processor 83 forms the product of the FCR(j) ramp window and the quasi-periodic signal segment. The resulting FCR(j) ramp segment is provided to the linear-phase low-pass filter 84. Similar in purpose to low-pass filter 72, low-pass filter 84 removes the higher frequencies from the ramp contribution to the excitation signal and compensates for its own filter delay. Because the filter 84 starts at the beginning of the ramp, all filter memory can be set to zero prior to the filtering operation. The output of low-pass filter 84 is the ramp part of FCR(j) which is to be added into the excitation signal. The zero-input response of the low-pass filter 84 is computed for the subframe starting at sample k+1 and concatenated to the ramp part. (The low-pass filter is chosen such that the zero input response decays to zero. Within sfl samples the resulting ramp part of FCR(j) is of length M+1 subframes, and is added to the buffer b in adder 845.

The balance of the embodiment concerns the computation of the part of the excitation signal resulting from the segment of the FCR(j) functions starting from subframe j, i.e., the contribution of the summation of the FCR(j) functions without their ramp segments. This computation is identical to that used in the conventional pitch predictor of FIG. 3, except that the embodiment operates on a vector (i.e., subframe) rather than a sample basis. For each subframe, the delay unit 88 has as input a vector $\vec{y}$. When concatenated, these vectors form a discrete signal y(i). Let us assume that the current subframe contains the samples k+1 through k+sfl. Then the delay unit 88 has as output a vector $\vec{y}$ which contains the samples y(i−d(i)) with i ranging from k+1 to k+sfl. The vector $\vec{y}$ forms the long-term predictor contribution to the excitation signal. The scaled fixed codebook vector $\lambda_f \vec{e}$ (which comes from the scaling unit 15 in FIG. 2) is the fixed-codebook contribution to the excitation signal. The adder 89, which has input the long-term predictor contribution and the fixed-codebook contribution, has as output the vector $\vec{y}$.

The vectors $\vec{y}$ produced by adder 89 have not been delayed. However, the ramp contribution output from filter 84 must precede the fixed-codebook contribution in time. To accomplish this, the vectors $\vec{y}$ are buffered in buffering unit 86. When the vector $\vec{y}$ enters the buffering unit 86 it is placed in subframe M+1 of the buffer b. Thus, if the vector $\vec{y}$ consists of sample y(k+1), y(k+2), . . . , y(k+sfl), and the buffer **86*b*** contains samples b(1) through b(sfl*(M+1)), then sample y(k+1) is placed in b(sfl*M+1), y(k+2) is placed in b(sfl*M+2), etc. The last sample y(k+sfl) is placed in b(sfl*M+sfl)=b(sfl*(M+1)).

In adder 845 the ramp-contribution $\vec{\rho}$, associated with a particular scaled fixed-codebook vector $\lambda_f \vec{e}$ is added to the buffer b. Both the ramp contribution and the buffer b are of length M+1 subframes ((M+1)*sfl samples). Extractor unit 85 extracts the first (in time) subframe of samples from the buffer as the excitation vector $\vec{x}$. These are the samples b(1) through b(sfl). Concatenation of these output vectors results in the excitation signal x(i), which is delayed by M*sfl samples. Thus, the coefficients of the linear-prediction synthesis filter must also be delayed by M*sfl samples.

The first sfl samples of the buffer b are then discarded in shifter 87 which moves the data by one subframe, or sfl samples, into the past. As an illustration of this shifting operation, sample b(sfl+1) becomes b(1), b(sfl+2) becomes b(2), and b(sfl*(M+1) becomes b(sfl*M). This operation can be described as the recursive operation b(i)←b(i+sfl), counting backwards from i=M*sfl to i=1. The revised buffer b vector is then returned to buffering unit 86 for processing of the next subframe.

The above discussion of the first and second illustrative embodiments implied usage of the ramped long-term delay predictor in the system receiver only. Note that the contents of the delay units 48 (FIG. 6) and 88 (FIG. 12) are, in the case of no channel errors, identical to those of the corresponding delay units in the system transmitter. The ramped contribution to the excitation does not affect the feedback of the conventional long-term predictor of FIG. 3. However, the ramped long-term predictor can be useful in the system transmitter.

Because the conventional CELP coder is an analysis-by-synthesis coder, the transmitter essentially has the same structure as the system receiver. For each subframe, the long-term-predictor delay is determined first. With the fixed-codebook contribution to the excitation set to zero for the present subframe, a candidate reconstructed speech signal for the present subframe is generated for all candidate delays d (for example, all integer and half-integer values between 20 and 148 samples), and the similarity of these candidate reconstructed signals and the original signal is computed. During the evaluation of the similarity criterion, a scaling of the candidate long-term predictor contributions which maximizes the similarity criterion is used. The similarity criterion usually involves perceptual weighting of both the candidate reconstructed speech signal and the original speech signal. Once the long-term predictor delay and gain are determined, the fixed-codebook contribution is determined. Given the selected long-term predictor contribution, scaled versions of all candidate vectors present in the fixed-codebook contribution are tried as candidate fixed-codebook contributions to the excitation signal. The fixed-codebook vector for which the similarity criterion between the resulting candidate reconstructed speech signal and the original signal is maximized is selected and its index transmitted. During the search procedure, the scaling for each of the candidate fixed-codebook vectors is set to the value which maximizes the perceptual similarity criterion.

The ramped long-term predictor can be used in the system transmitter when the gain of the long-term predictor is computed. Instead of determining the gain by maximizing the similarity of the (candidate) reconstructed and original speech signals in the present subframe, the gain can be computed by maximizing the similarity of the (candidate) reconstructed and original speech signals over a time segment which includes the ramp. A separate gain term can also be used for the ramp segment. A simple two-bit quantization would consist of comparing the similarity between original and reconstructed speech with and without the ramp part of FCR(j). The system receiver would be instructed to use the ramped long-term predictor only if the ramp part increased the similarity criterion.

The description of the design of an improved long-term predictor has focused on increasing the periodicity of the reconstructed signal in a frequency selective manner. However, for some coders the level of periodicity is too high, particularly at the higher frequencies, even without any periodicity enhancement. This periodicity at higher frequencies can be removed by dithering the delay; that is, by adding noise or some deterministic sequence to the long-term predictor delay function d(i). This method can be used in combination with both the first and second illustrative embodiments of the ramped long-term predictor, which means that the periodicity of the higher frequency regions can be decreased, while simultaneously the periodicity of the lower frequency regions is increased. To get best performance, identical dithering of the delay value should be applied to the system transmitter and to the system receiver. For this purpose, a fixed table of dithering values, present in both the system receiver and the system transmitter, can be used. The dithering values can be repeated every 20 ms or so.

When using the dithering technique, delay values for samples near to each other in time should be sufficiently similar. This guarantees that the basic features of the excitation signal (such as sharp peaks) are maintained. For example, a triangular wave, with a maximum amplitude of 1 sample, and a period of 20 samples can be added to the delay. The amplitude of the dithering signal can be varied within the pitch cycle. Advantageously, the dithering amplitude is increased during relatively quiet regions within the pitch cycle and decreased at the pitch pulses.

In the above embodiments, an infinite impulse response falter arrangement was disclosed for use as a long term predictor. It will be apparent to those of ordinary skill in the art that other types of LTPs may be employed. For example, other types of LTPs include adaptive codebooks and structures which introduce (quasi-) periodicity into a non-periodic signal.

I claim:

1. A method of increasing the periodicity of a reconstructed speech signal with use of a long term predictor, the long term predictor receiving a speech excitation signal as input and generating an output signal based on the excitation signal, the method comprising the steps of:

generating a first signal based on the excitation signal and at least one scale factor;

delaying the output signal of the long term predictor relative to said first signal; and summing the first signal with the delayed output signal of the long term predictor to produce an output signal having increased periodicity as compared to the output signal of the long term predictor.

2. The method of claim 1 wherein the step of generating comprises delaying the excitation signal, wherein delay which is applied to samples of the excitation signal is less than delay applied to samples of the output signal of the long term predictor.

3. The method of claim 2 wherein the gain is less than one.

4. The method of claim 2 wherein the delay applied to samples of the excitation signal is based on at least one long term predictor delay signal value.

5. The method of claim 2 wherein the delay applied to samples of the excitation signal is based on a long term predictor delay signal, said delay signal comprising a series of long term predictor delay signal sample values which vary over time.

6. The method of claim 1 wherein the step of generating comprises the step of filtering the first signal with a filter.

7. The method of claim 6 wherein the filter is a linear-phase, low-pass filter.

8. The method of claim 1 wherein the step of delaying the output signal of the long term predictor comprises the step of delaying the input signal to the long term predictor.

9. The method of claim 1 wherein the step of generating comprises performing interpolation based on contiguous samples of the excitation signal.

10. The method of claim 1 wherein said at least one scale factor comprises a ramp window.

11. An apparatus for increasing the periodicity of a reconstructed speech signal, the apparatus for use with a long term predictor, the long term predictor for receiving a speech excitation signal as input and for generating an output signal based on the excitation signal, the apparatus comprising:

means for generating a first signal based on the excitation signal and at least one scale factor;

means for delaying the output signal of the long term predictor relative to said first signal; and means for summing the first signal with the delayed output signal of the long term predictor to produce an output signal having increased periodicity as compared to the output signal of the long term predictor.

12. The apparatus of claim 11 wherein the means for generating comprises means for delaying the excitation signal, wherein delay applied to samples of the excitation signal is less than delay which is applied to samples of the output signal of the long term predictor.

13. The apparatus of claim 11 wherein the at least one scale factor is less than one.

14. The apparatus of claim 12 wherein the delay applied to samples of the excitation signal is based on at least one long term predictor delay signal value.

15. The apparatus of claim 12 wherein the delay applied to samples of the excitation signal is based on a long term predictor delay signal, said delay signal comprising a series of long term predictor delay signal sample values which vary over time.

16. The apparatus of claim 11 further comprising a filter, said filter filtering the first signal.

17. The apparatus of claim 16 wherein the filter is a linear-phase, low-pass filter.

18. The apparatus of claim 11 wherein the means for delaying the output signal of the long term predictor comprises the means for delaying the input signal to the long term predictor relative to said first signal.

19. The apparatus of claim 11 wherein the means for generating comprises means for performing interpolation based on contiguous samples of the excitation signal.

20. The apparatus of claim 11 wherein the at least one scale factor comprises a ramp window.

* * * * *